United States Patent [19]

Lucas

[11] 4,145,823

[45] Mar. 27, 1979

[54] SNOW REMOVING DEVICE

[76] Inventor: Paul A. Lucas, 2605 St. Clair Ave., East Liverpool, Ohio 43920

[21] Appl. No.: 887,078

[22] Filed: Mar. 15, 1978

[51] Int. Cl.[2] ..... E01H 4/00

[52] U.S. Cl. ..... 37/10; 172/547; 15/300 R; 15/383; 37/53

[58] Field of Search ..... 37/10, 53, 12; 172/547, 172/605, 608; 15/300 R, 383

[56] References Cited

U.S. PATENT DOCUMENTS

| | | | |
|---|---|---|---|
| 698,566 | 4/1902 | Shirreffs | 37/10 |
| 922,246 | 5/1909 | Belding | 172/547 X |
| 1,219,793 | 3/1917 | Winner | 172/547 X |
| 2,582,199 | 1/1952 | Gardner et al. | 172/547 |
| 3,346,973 | 10/1967 | Meyer et al. | 37/10 |
| 3,496,843 | 2/1970 | Wallingford | 37/10 X |
| 3,652,106 | 3/1972 | Waterman | 280/405 R |

FOREIGN PATENT DOCUMENTS

| | | | |
|---|---|---|---|
| 889308 | 1/1944 | France | 172/547 |
| 383792 | 5/1973 | U.S.S.R. | 172/547 |

*Primary Examiner*—E. H. Eickholt
*Attorney, Agent, or Firm*—Webster B. Harpman

[57] ABSTRACT

A snow removing device has a hollow roller with closely spaced apertures forming its surface through which partially compacted snow moves as the roller advances. A suction blower communicates with the hollow roller to continuously remove snow therefrom and a secondary roller having fingers engagable with the apertures in the first roller is arranged as an idler with respect thereto. A framework engages the rollers and supports the suction blower and provides a handle for moving the snow removing device.

7 Claims, 3 Drawing Figures

SNOW REMOVING DEVICE

BACKGROUND OF THE INVENTION

1. Field of the Invention

This invention relates to snow removing devices which are arranged to engage, pick up and remove snow from a desired area, such as a sidewalk or a driveway.

2. Description of the Prior Art

Prior devices have generally comprises snow removing augers, paddles, plows and similar devices which engage the snow and forcefully remove it.

This invention acts to move the snow into a hollow roller through the perforated surface thereof and avoids the problems that exist with the prior art snow removing devices.

SUMMARY OF THE INVENTION

A snow removing device comprises a hollow roller, the cylindrical surface of which is provided with a number of closely spaced apertures, a frame journals the roller and supports a suction blower and drive means for the roller together with a secondary roller having a plurality of fingers thereon for registry with the apertures in the first roller. In operation the apertured roller partially compacts snow or breaks up compacted snow as it moves into the hollow interior from whence it is removed by the suction blower. Snow remaining in the apertures is removed by the engagement of the fingers on the secondary roller.

DESCRIPTION OF THE PREFERRED EMBODIMENT

Figure 1:
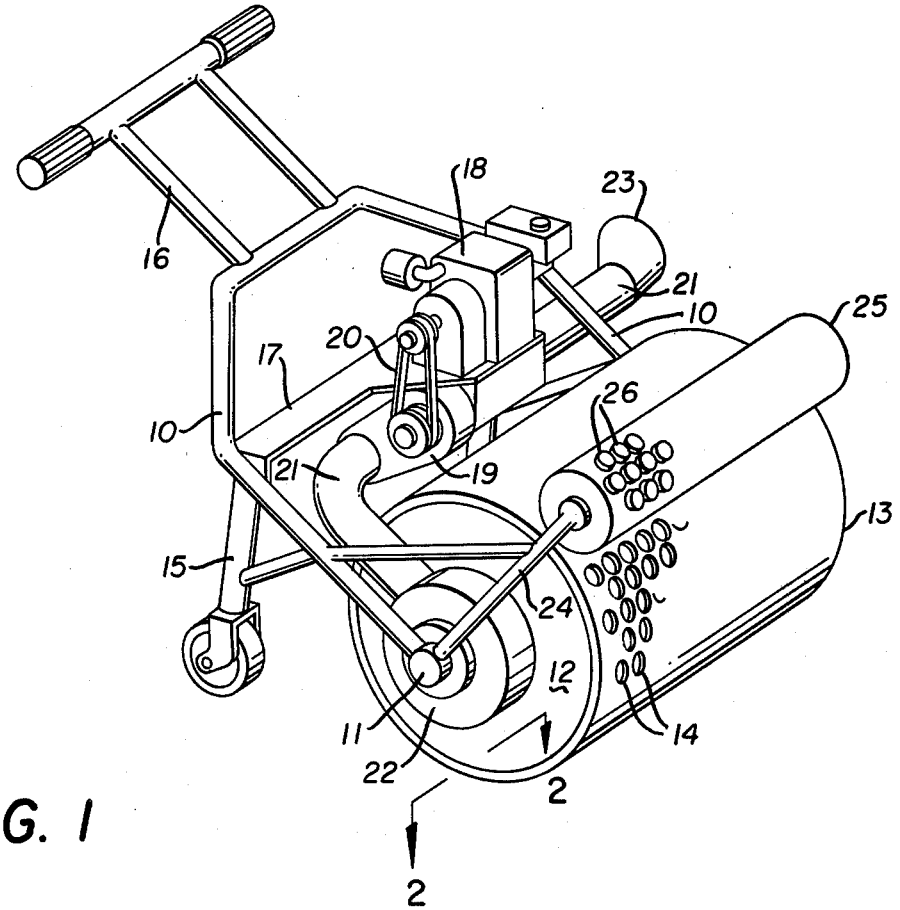
FIG. 1 is a perspective view of the snow removal device.

In its simplest form the snow removing device disclosed herein includes a frame 10 having journals 11 for the reception of spindles centrally positioned on the ends 12 of a hollow roller 13. The cylindrical body of the hollow roller 13 is provided with a plurality of closely spaced apertures 14, the frame 10 has steerable ground engaging wheels 15 on one portion thereof and an upwardly and angularly disposed handle 16 on another portion.

A transverse portion 17 of the frame 10 mounts an internal combustion engine 18 which is arranged to drive the snow removing device and to power a suction blower 19 as by way of a flexible belt 20. The suction blower 19 is positioned in duct work 21, one end of which communicates with a housing 22 which in turn communicates with the interior of the hollow roller 13 and the other end of the duct work 21 has a discharge guide 23.

Extensions 24 of the frame 10 rotatably support a secondary roller 25 which has a plurality of fingers 26 thereon which are arranged for individual registry with the individual apertures 14 in the hollow roller 13.

It will thus be seen that when the engine 18 is operating the snow removing device may be moved into snow to be removed where it will partially compact the same and result in moving the partially compacted snow through the apertures 14 into the hollow interior of the roller 13 from whence it is removed by way of the housing 20 and the duct work 21 through the action of the suction blower 19.

Additionally the energy from the engine 18, in the form of rotary motion, is imparted through means not shown to the hollow roller 13 to make the device self-propelling. When used on compacted snow or the like the grid-like action of the metal of the hollow roller 13 between the closely spaced apertures 14 acts to break up the ice and move the same into the interior of the hollow roller 13 from whence it is removed by the action of the suction blower 19 as heretofore described.

Figure 3:
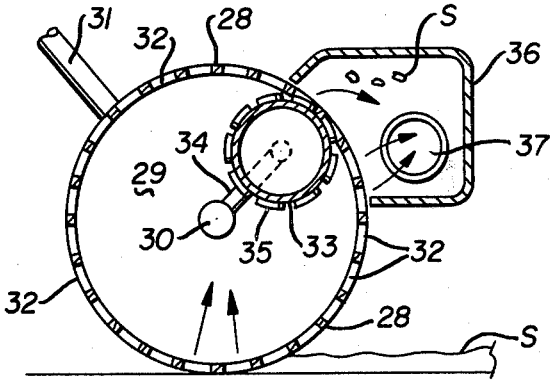
FIG. 3 is a vertical section through a modified form of a snow removal device.
Figure 2:
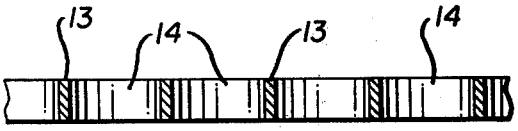
FIG. 2 is an enlarged section on line 2—2 of FIG. 1.

Modifications of the structure will occur to those skilled in the art and one such modification may be seen by referring to FIG. 3 of the drawings.

In FIG. 3 of the drawings a hollow roller 28 is disclosed. It has closed ends 29 and spindles 30 thereon are engaged by journals carried on a frame 31, only a portion of which is illustrated in FIG. 3 of the drawings as it is otherwise the same as the frame heretofore described in connection with FIG. 1.

A plurality of large apertures 32 are formed in closely spaced relation in the cylindrical surface of the hollow roller 28. A smaller secondary roller 33 is positioned within the roller 28 and rotatably supported on the ends of arms 34 which extend from the central portions of the spindles 30 heretofore referred to. The surface of the roller 33 is provided with a plurality of fingers 35 so as to engage in the apertures 32 and push any snow therein outwardly thereof and into a housing 36 which is carried by the frame 31 in close proximity to the surface of the roller 28. A suction blower not shown communicates with an opening 37 in the housing 36 so that snow moved thereinto by the fingers 35 will be withdrawn therefrom and discharged as will be understood by those skilled in the art.

It will thus be seen that a snow removing device has been disclosed which operates on the novel principal of partially compacting snow and separating it into portions that are delivered into a hollow roller from which they are removed to a point of discharge by a suction blower.

Although but one embodiment of the present invention has been illustrated and described, it will be apparent to those skilled in the art that various changes and modifications may be made therein without departing from the spirit of the invention, and having thus described my invention what I claim is:

1. A snow removing device comprising a cylindrical roller having a plurality of closely spaced apertures in the cylindrical surface thereof, means in said device for journaling said cylindrical roller, end closures in said cylindrical roller and suction means in said device in communication with said cylindrical roller for moving snow therefrom, means in said device for intermittent engagement with said apertures in said cylindrical surface of said roller arranged to move snow therefrom, said means comprising a secondary roller, a plurality of projecting elements on the surface of said secondary roller, said projecting elements arranged for registry with said plurality of closely spaced apertures when said secondary roller and said cylindrical roller revolve.

2. The snow removing device set forth in claim 1 and wherein spindles are positioned centrally of said end closures and engaged in journals in said device.

3. The snow removing device set forth in claim 1 and wherein a power source is positioned in said device and connected with said suction means for actuating the same.

4. The snow removing device set forth in claim 1 and wherein a power source is positioned in said device and connected with said suction means for actuating the same and means connecting said power source with said cylindrical roller for revolving the same so as to move said snow removing device.

5. The snow removing device set forth in claim 1 and wherein said secondary roller is arranged in frictional engagement with the cylindrical surface of said cylindrical roller.

6. A snow removing device set forth in claim 1 and wherein a housing is mounted longitudinally of said cylindrical roller and in communication with a portion of the surface thereof and said section means communicates with said housing and wherein said secondary roller is located within said cylindrical roller.

7. The snow removing device set forth in claim 1 and wherein said suction means communicates with an opening in at least one of said end closures and said secondary roller is mounted exteriorly of said cylindrical roller.

* * * * *